United States Patent [19]

Agronin et al.

[11] Patent Number: 4,606,264

[45] Date of Patent: Aug. 19, 1986

[54] METHOD AND APPARATUS FOR TEMPERATURE GRADIENT CALENDERING

[75] Inventors: Ronald D. Agronin; Paul J. Klemmer, both of Appleton, Wis.

[73] Assignee: Wartsila-Appleton, Incorporated, Appleton, Wis.

[21] Appl. No.: 688,650

[22] Filed: Jan. 4, 1985

[51] Int. Cl.[4] ..... B30B 13/00; B30B 3/04; B30B 15/34

[52] U.S. Cl. ..... 100/38; 100/93 RP; 100/162 B; 29/116 AD

[58] Field of Search ..... 100/93 RP, 162 B, 38; 29/116 AD, 113 AD

[56] References Cited

U.S. PATENT DOCUMENTS 1,739,572 12/1929 Bidwell ..... 100/93 RP
3,190,212 6/1965 Moore ..... 100/93 RP X
4,194,446 3/1980 Palovaara ..... 100/162 B
4,432,277 2/1984 Hartmann ..... 100/162 B

OTHER PUBLICATIONS

Crotogino article, "Temperature-Gradient Calendering", Tappi Journal, Oct. 1982, pp. 97-101.

*Primary Examiner*—Peter Feldman
*Attorney, Agent, or Firm*—McDougall, Hersh & Scott

[57] ABSTRACT

A web of paper or similar material is subjected to at least one nip formed by an iron roll and a compliant roll. The iron roll is heated to a temperature of at least the temperature at which the fibers in the web begin to deform. In the case of paper this is approximately 350° F. Preferably the web is passed through two nips the first nip polishing one side of the web, the second nip polishing the other side. The result is a web having improved gloss without substantial loss of bulk and with minimum mottling.

4 Claims, 5 Drawing Figures

METHOD AND APPARATUS FOR TEMPERATURE GRADIENT CALENDERING

BACKGROUND OF THE INVENTION

This invention relates to the calendering of webs formed of paper or similar substances. Paper webs used, for example, in the manufacture of magazines, newspapers and the like, must be calendered for the purpose of polishing the surface so that it will accept ink properly and be easily readable. Calendering is the act of polishing the web by passing it through one or more nips of a calender machine. The nips are formed by pairs of opposed rollers.

There are several types of calendering operations. One type, known as supercalendering, consists of passing a web sequentially through a series of nips formed by pairs of iron and filled rolls. The term supercalendering is used because there may be eight or more such nips through which the web passes. Supercalendering can impart useful properties to the web including improved gloss, density, smoothness and the like.

Another type of calendering is the single or dual pass machine calender in which relatively few nips formed by pairs of iron rolls are employed as, for example, one or two nips. Such calendering is satisfactory for some grades of paper but is suited for manufacturing paper with high gloss and smoothness for quality printing.

If possible, of course, it would be preferred to put a web through as few nips as possible to obtain the desired characteristics necessary for quality printing.

A web passing through multiple nips becomes increasingly less able to tolerate additional processing without breaking, tearing, cracking, etc. Accordingly, it would be highly desirable to produce a quality paper without the need for supercalendering a web. In short, it would be desirable to produce quality paper from a calendering operation involving only a few nips, say two or less.

It is known in the prior art to temperature gradient calender a web for the purpose of obtaining improved gloss, smoothness, strength and ink transfer capabilities. Such knowledge is described in an article authored by R. H. Crotogino, published in the Tappi Journal dated October, 1982, at pages 97 through 101. The Crotogino article describes a calendering operation in which a web is passed through a pair of nips formed by heated iron rolls. The rolls are heated to a temperature of approximately 210° C. (410° F.). By temperature gradient calendering it is meant that there is a significant difference between the temperatures to which the web surface and the interior of the web are subjected. Thus, when a relatively cold web contacts the very hot iron rolls, a significant temperature differential exists between the surface of the web and the interior portion. When the web is compressed by the nips of the heated rolls the hot outer web surface is deformed more than the interior resulting in a smoother, glossier web which is higher in strength and has better ink transfer capability than webs which are machine calendered at moderate temperature. Indeed, Crotogino suggests that nip temperature gradient calendering can approach the quality obtained by supercalenders with respect to smoothness and gloss.

The Crotogino device obtains a constant caliper of the web but not constant density. This is due primarily to the rigidity of the heated iron rolls. This lack of density control results in mottling of the web. By mottling it is meant that deviations inherent in a web (high and low spots) are not treated equally by the nip. Thus, high spots are made glossier and smoother than the low spots which are not subjected to the same temperature and pressure.

It is desirable to provide a method and apparatus which has the benefits of temperature gradient calendering—few nips—but can produce high quality webs without mottling.

It is accordingly an object of the present invention to provide an improved method and apparatus for temperature gradient calendering which can obtain the advantages of temperature gradient calendering, namely few nips, while at the same time producing a high quality web of constant density and little or no mottling.

It is a further object of the invention to provide a two nip temperature gradient calendering method and apparatus utilizing a heated iron roll in conjunction with an unheated compliant roll whereby both sides of a web can be treated.

A further object of the invention is to provide a temperature gradient calendering method and apparatus employing a crown control compliant roll to maximize the quality of the polishing action.

Other objects and advantages of the invention will be apparent from the remaining portion of the description.

SUMMARY OF THE INVENTION

The invention combines the advantages of supercalendering with the benefits of temperature gradient calendering whereby relatively few nips are required to produce a web having improved gloss, smoothness and ink transfer characteristics while at the same time having the qualities otherwise obtainable only from supercalendering. This is achieved by utilizing two pair of rollers forming two nips (assuming both sides of the web are to be treated). The first nip employs a heated iron roll and an unheated compliant roll. The second nip includes the same roll pair but in an inverted position to treat the other side of the web. The iron rolls are heated to a temperature of at least 350° F. which is the approximate temperature at which the cellulose fibers begin to soften and deform in the web. In a preferred embodiment of the invention the compliant roll, which can be made of Nomex® or other available resilient materials, may incorporate a zone control system. By zone control it is meant that the crown geometry can be varied to eliminate hot spots caused by variations in the web profile or in the rolls due to wear or damage.

DETAILED DESCRIPTION

The invention relates to temperature gradient calendering. This technique involves the use of high temperature rolls for calendering the web, temperatures greatly in excess of the temperature of the web prior to its entering the calendering nip.

In standard calendering operations, whether machine calenders or supercalenders are employed, the maximum working temperature is usually no more than 200° F. This temperature is produced by heating the iron rolls which form at least one of the two rolls for each nip. In some cases the iron roll opposes a compliant roll which, during extended operation of the calender, may itself become as hot or hotter than the iron roll. Machine calendering (few nips) cannot produce high gloss paper with constant density. When higher gloss is desired it is necessary to employ a supercalender having a plurality of nips (on the order of 9 to 11) to achieve the desired result. This, however, has an adverse affect on bulk and, of course, requires expensive machinery in a secondary processing operation.

By contrast, temperature gradient calendering, employing only one or two nips, can obtain high gloss without substantial loss of bulk. Further this can be accomplished, if desired, "on-machine", meaning directly as the web comes from the paper making machine rather than as a secondary treatment of an existing web as in the case of supercalendering. In temperature gradient calendering one or both of the rolls forming a nip is heated to a temperature of at least 350° F. This temperature is critical but dependent upon the "flow temperature" of the particular fibers of the web. In order to achieve effective temperature gradient calendering the nip temperature must be sufficient to cause the surface fibers of the web to deform.

Figure 1A:
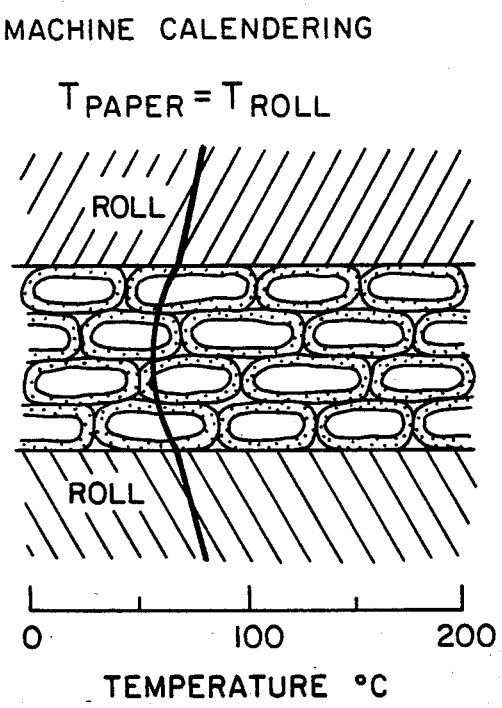
FIGS. 1A and 1B are is a reproductions of figures which appears in the Crotogino article referenced in the background portion of the specification.
Figure 1B:
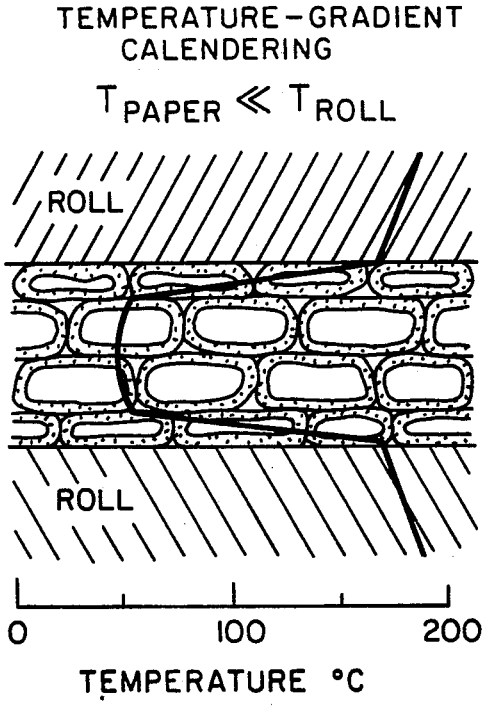

Temperature gradient calendering using two heated iron rolls is described in the aformentioned prior art reference to Crotogino. FIG. 1 is a reproduction of a figure from the Crotogino reference showing the temperature gradient difference between ordinary calendering and temperature gradient calendering. As can be seen in the left hand portion of the figure, in ordinary calendering the temperature difference between the calender rolls and the paper is small as is the temperature variation through the thickness of the web. The nip pressure deforms the entire web uniformly through its thickness as a result. Thus, high gloss requires many nips and results in a loss of web bulk.

In the case of temperature gradient calendering the web is contacted by very hot calender rolls producing the indicated high temperature gradient as between the surface and the central portion of the web. Nip pressure on the hotter surfaces of the web cause them to deform more than the central portion of the web resulting in improved gloss, with lower bulk loss.

Crotogino, therefore, represents an improvement in that high gloss can be obtained with only a few nips. Crotogino's method, however, employing two heated iron rolls, produces a web having constant caliper (thickness) but not constant density due to the inevitable variations (high and low spots) present in a web. As a result Crotogino's technique, although producing higher average gloss, yields a mottled web in which some portions of the web are glossier than others. This effect can interfere with printing operations by causing variations in ink transfer and ultimately the readability of the paper.

According to the present invention the advantage of high temperature calendering—higher gloss with fewer nips—is obtained but without mottling. The present invention employs at least one nip formed by a heated iron roll and a resilient or compliant roll. If only one side of the web needs calendering a single nip is sufficient. If both sides of a web are to be calendered, two nips are required. If further improvement to the web is desired, paper calendering with three or more nips may be required.

Figure 2:
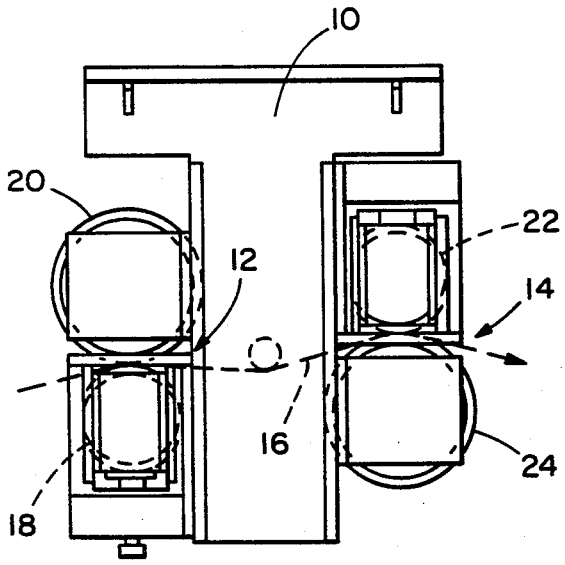
FIG. 2 is a schematic diagram of an apparatus suitable for performing the method according to the invention.

For purposes of illustrating the invention, FIG. 2 shows a dual nip arrangement suitable for practicing the invention. In FIG. 2 a support column 10 is provided with two pairs of rollers forming a first nip 12 and a second nip 14 through which a web 16 passes. Nip 12 is formed by a heated iron roll 18 and an unheated compliant roll 20. Nip 14 is similarly formed by an iron roll 22 and a compliant roll 24. Note, however, that the relative positions of the iron roll and compliant roll are reversed so that both surfaces of the web 16 are treated. According to the invention the iron rolls 18 and 22 are heated to the necessary temperature at which the fibers in the web surface begin to deform. This is in the approximate range of 350° to 400° F. The compliant rolls 20 and 24 may be formed from a variety of resilient materials, such as Nomex ®, paper filled rolls and the like. They are not heated although they become quite hot due to heat transfer from the iron roll.

Because the complaint rolls conform to variations in the web the mottling effect produced by Crotogino's technique is avoided. The present invention is capable of producing high gloss at a selected, constant density. The gloss on the web is relatively uniform and the density of the web is substantally constant. Referring to the table below, there is provided comparative data for conventional supercalendering, the Crotogino method and the present invention.

TABLE 1

COATED PAPER

| | Gardner Gloss | | Print Surf (roughness) | |
|---|---|---|---|---|
| | Felt | Wire | Felt | Wire |
| Supercalender (9 nips) | 87 | 82 | 1.21 | 1.59 |
| Crotogino 2 heated iron rolls (1 pass) | 72 | 70 | 1.90 | 2.20 |
| Present Invention 1 heated iron roll, 1 compliant roll (2 passes) | 82 | 81 | 1.47 | 1.69 |

TABLE 2

NEWSPRINT

| | Gardner Gloss | | Print Surf (roughness) | |
|---|---|---|---|---|
| | Felt | Wire | Felt | Wire |
| Supercalender (9 nips) | 27 | 35 | 2.13 | 2.06 |
| Crotogino 2 heated iron rolls (1 pass) | 26 | 24 | 3.47 | 3.51 |
| Present Invention 1 heated iron roll, 1 compliant roll (2 passes) | 33 | 35 | 2.41 | 2.40 |

As can be seen from the table, the present invention produces a product having excellent gloss and Parker Print Surf (a measure of roughness). In reviewing the data it must be understood that exact comparisons are difficult to make because of the sample to sample variation of paper webs, slight differences in the testing procedures and the error limitations of the measurement techniques. Nevertheless one can properly conclude from the data that the present invention provides an excellent web, comparable to supercalendering and generally better than the temperature gradient calendering obtained by the Crotogino technique while avoiding the mottling problem.

Figure 3:
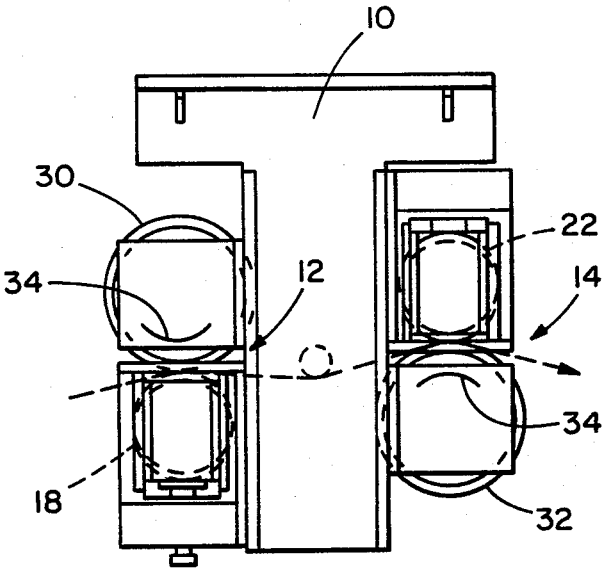
FIG. 3 is a view of a preferred embodiment of the invention employing an adjustable crown compliant roll.

Referring not FIG. 3, a preferred embodiment of the invention is illustrated. In FIG. 3 the elements which are identical to FIG. 2 have been similarly numbered. This embodiment of the invention employs a specially constructed compliant rolls 30 and 32 having variable crown control. Variable crown control rolls can adjust their profile along the transverse direction of the web to eliminate hot spots caused by uneven wear of the rolls, uneven loading (nip pressure) or other factors normally encountered in the calender operation.

In the prior art variable crown rolls are usually iron rolls. For purposes of the present invention, however, it is desired to provide the compliant roll with variable crown capability. This is necessary because existing variable crown rolls cannot be heated to the high temperatures (350°–400° F.) necessary to perform temperature gradient calendering according to the present invention.

Figure 4:
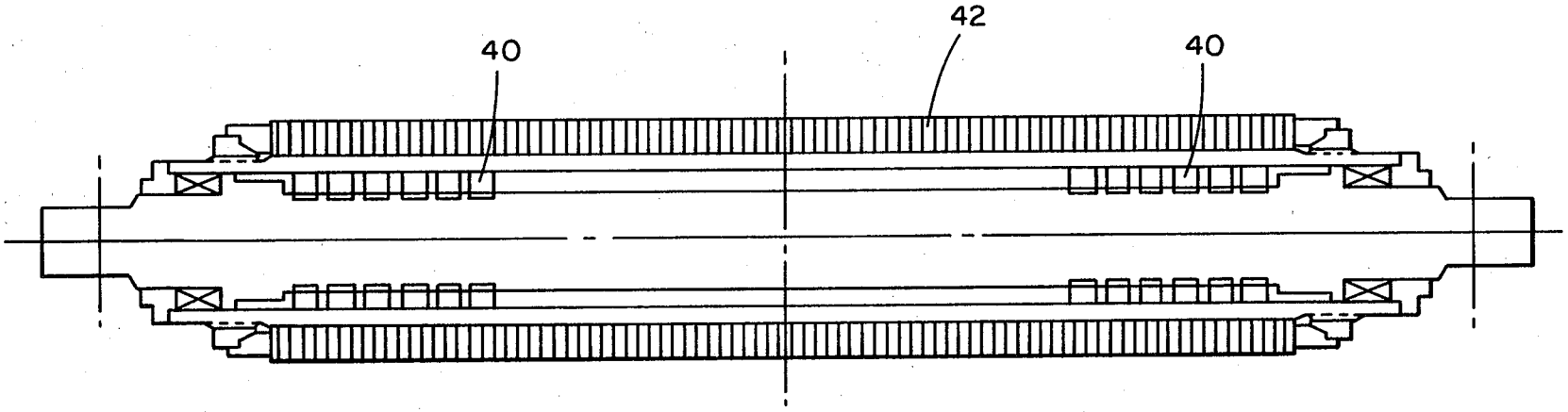
FIG. 4 is a drawing indicating the manner in which the adjustable crown control roll operates.

As shown in FIG. 4, the compliant roll is a variable crown roll. Its profile is adjusted by the calender operator as a function of a variable related to the quality of the web as, for example, temperature profile across the nip, caliper of the web measured after calendering, etc. The mechanism for adjusting the crown and the techniques for controlling the adjusting means are known in the art as disclosed, for example, in U.S. Pat. Nos. 4,327,468 and 4,480,537, the latter being assigned to the present assignee and incorporated herein by reference. Briefly, the mechanism includes a hydraulic servo system including a pump for supplying oil to selected elements 40 to alter the profile of the calendering surface 42 of the compliant roll.

In operation, the iron rolls 18 and 22 are preheated to the required temperature of approximately 350° to 400° F. The web is then passed through the nips and exposed to the iron roll and compliant rolls to polish it thereby improving the gloss and smoothness of the web surface without significant loss of bulk. Density is maintained substantially constant due to the ability of the compliant roll to conform to variations in the web and to even out web variations. This ability is optimized by the use of complaint rolls having variable crown adjustment capability. The resulting web has high gloss and smoothness, good bulk, constant density and, of equal importance, mottling is not appreciable.

While we have shown and described embodiments of the invention, it will be understood that this description and illustrations are offered merely by way of example, and that the invention is to be limited in scope only as to the appended claims.

We claim:

1. A method for temperature gradient calendering of a paper web to obtain a high gloss, smooth surface while maintaining web density substantially constant comprising the steps of:

(a) providing at least one nip for each surface of the web to be calendered, said nip being formed by an iron roll and a compliant roll;

(b) heating the iron roll to a temperature of at least 350° F., sufficient to cause the surface fibers in the paper web to deform but less than the temperature required to deform the interior fibers, thereby to leave the interior fibers relatively cooler and substantially unchanged; and (c) passing said web through each nip to obtain said high gloss, smooth surface.

2. The method of claim 1 wherein the crown of the compliant roll is variable and step (a) includes the substep of varying the compliant roll profile to compensate for web variation, roll wear, hot spots and the like thereby to insure substantially constant density of the web and to reduce mottling.

3. The method of claim 1 wherein step (b) involves heating said iron roll to a temperature in the range of about 350° F. to 400° F.

4. A method of temperature gradient calendering a paper web comprising the steps of: passing the web through at least one nip formed by first and second rolls, the first roll being an iron roll heated to a temperature of at least 350° F., sufficient to cause the surface fibers in the web to deform, said temperature being insufficient to cause interior fiber deformation due to the relatively cooler temperature to which the interior fibers are heated, the second roll being a compliant, variable crown control roll having means to permit profile variation across the nip to optimize surface gloss and smoothness to maintain density and minimize mottling.

* * * * *